US005497985A

United States Patent [19]

Byttebier et al.

[11] Patent Number: 5,497,985

[45] Date of Patent: Mar. 12, 1996

[54] METHOD AND APPARATUS FOR TEMPORARILY STORING AND TRANSPORTING SUCCESSIVE TEXTILE SHEETS

[75] Inventors: Gaspar A. H. Byttebier, Grote Heerweg 64, B-8791 Waregem-Beveren; Hendrik Lefebvre, Harelbeke, both of Belgium

[73] Assignee: Gaspar A. H. Byttebier, Waregem-Beveren, Belgium

[21] Appl. No.: 122,483

[22] PCT Filed: Mar. 24, 1992

[86] PCT No.: PCT/BE92/00008

§ 371 Date: Feb. 23, 1994

§ 102(e) Date: Feb. 23, 1994

[87] PCT Pub. No.: WO92/17395

PCT Pub. Date: Oct. 15, 1992

[30] Foreign Application Priority Data

Mar. 26, 1991 [BE] Belgium ..... 09100278

[51] Int. Cl.[6] ..... B65H 29/66

[52] U.S. Cl. ..... 271/7; 271/272; 271/275; 271/198; 271/202; 271/200; 271/300; 271/216; 271/902; 198/470.1; 198/586; 198/604

[58] Field of Search ..... 271/6, 7, 1, 3, 271/3.1, 266, 272, 273, 274, 275, 150, 151, 162, 163, 300, 182, 198, 199, 200, 201, 202, 203, 213–216, 902, 184–186, 245; 198/370–372, 678.1, 680, 470.1, 604, 586

[56] References Cited

U.S. PATENT DOCUMENTS

| | | | |
|---|---|---|---|
| 2,274,075 | 2/1942 | La Bombard | 271/216 X |
| 2,391,170 | 8/1942 | Labombarde . | |
| 3,682,473 | 8/1972 | Kuyt | 271/199 |
| 3,710,955 | 1/1973 | Redman et al. | 198/379 |
| 3,735,977 | 5/1973 | Reist . | |
| 3,871,644 | 3/1975 | Stobb | 271/186 X |
| 3,981,495 | 9/1976 | Bijttebier . | |
| 4,183,518 | 1/1980 | Brockmuller et al. . | |
| 4,237,677 | 12/1980 | Klapp | 271/200 X |
| 4,348,018 | 9/1982 | Bijttebier et al. . | |
| 4,366,955 | 1/1983 | Pessina | 271/162 X |
| 4,437,655 | 3/1984 | Bijttebier et al. . | |
| 4,572,499 | 2/1986 | Bijttebier et al. . | |
| 4,645,194 | 2/1987 | Stobb | 271/203 |
| 4,667,950 | 5/1987 | Linder et al. | 271/245 |
| 4,953,843 | 9/1990 | Reist | 271/184 X |
| 5,090,674 | 2/1992 | Ozawa | 271/3.1 |
| 5,318,288 | 6/1994 | Byttebier et al. | 271/216 |

FOREIGN PATENT DOCUMENTS

| | | | |
|---|---|---|---|
| 960352 | 4/1950 | France . | |
| 2299154 | 8/1976 | France . | |
| 2519615 | 7/1983 | France . | |
| 2631011 | 11/1989 | France . | |
| 2119795 | 11/1971 | Germany | 271/202 |
| 2224981 | 1/1979 | Germany | 271/213 |
| 1542468 | 3/1979 | United Kingdom . | |
| 9104214 | 4/1991 | WIPO . | |

*Primary Examiner*—H. Grant Skaggs
*Attorney, Agent, or Firm*—Cushman Darby & Cushman

[57] ABSTRACT

A method is provided for temporarily storing a series of successive textile sheets having a length L in an overlapping relationship in a collecting apparatus, including the successive steps of conveying the textile sheets one after another to an inlet of a carrier mechanism, while preventing an uncontrolled relative movement with a neighboring sheet in an overlapping contact area, clamping each textile sheet between the carrier mechanism and cooperating clamping means and conveying the clamped textile sheets along a path to an outlet of the carrier mechanism in successive steps having an adjustable step length d, removing the textile sheets from the collection apparatus at the outlet without disturbing a position of a neighboring sheets and displacing the carrier mechanism by one of translation, rotation and translation combined with rotation around one of a vertical axis and at least one horizontal axis.

16 Claims, 7 Drawing Sheets

METHOD AND APPARATUS FOR TEMPORARILY STORING AND TRANSPORTING SUCCESSIVE TEXTILE SHEETS

The invention relates to a method and apparatus for processing sheets, particularly a series of successive textile sheets. In clothing manufacture it is often necessary to process and treat series of successive sheets. Processing can comprise one or more operations, such as hemming the sheets, positioning, joining, turning over or reversing, folding, etc. Up to now the majority of the machines must be repeatedly fed manually. This requires many operating personnel and considerable in-process stocks of sheet stacks at each processing unit. At the same time, these in-process stocks takeup a significant amount of space in the workshop.

Numerous attempts have already been made to do something about this. In particular, applicant has developed systems for removing sheets one by one from a well ordered stack and feeding them in the correct position to one or more processing units. These sheet stacks generally come directly from the cutting room in the clothing manufacturing workshop. With a well ordered stack is meant hereinafter a stack wherein the sheets are ordered in an essentially completely overlapping arrangement with the same orientation. Such systems are known for instance from U.S. Pat. Nos. 3,981,495, 4,348,018, 4,437,655 and 4,572,499 of applicant. Now, when these sheets leave this processing unit one by one to undergo a supplementary operation in a following station, they generally need to be collected or restacked one way or the other. During this restacking operation, they then have to be collected or brought together again as precisely as possible in the desired position with a view to a smooth supply to this following processing station. Assuming that the processed sheets, delivered by a first processing unit, can be automatically stacked on top of each other in a smooth and precise way in a form analogous to that of original stacks that come from the cutting shop, a machine in accordance with U.S. Pat. No. 4,572,499 would be well suitable for a supply to a second (and following) processing station. This automatic precise stacking is a problem, however, so that the machine is as yet less usable as automatic feeder of already partly processed sheets to a second or following processing unit.

Therefor, applicant has designed a useful winding apparatus in which the successive sheets are clamped between the successive windings of a belt roll as a storage or stacking device for these sheets. This apparatus and its application in the processing of textile sheets is thoroughly described in patent application PCT/BE 90/00052 (WO 91/04214). Although this apparatus already provides for a flexible means of storing the sheets, in certain cases the disadvantage still remains that is inherent in the fact that the first sheet taken up always remains inside the winding, a fact which hinders easy accessibility for particular processing requirements. Indeed, if one wants to further process all the sheets in the sequence they were taken up in the winding, then the winding or coil must first be rewound to a second coil. Furthermore, with a winding in operation one must take into account the fact that the diameter (measured from the clamp line) is continuously changing. For example, with a constant sheet inlet and outlet speed, respectively into and out of the windings, the angular velocity of the windings will therefore be continuously changing, which fact can complicate the speed control of the winding drive.

The present invention makes it possible to avoid these disadvantages by providing movable collecting apparatuses and a method for the temporary and partially overlapping storage of successive supple sheets delivered from an ordered stack of sheets or from a processing unit in an apparatus, and more particularly in its storage area between a carrier for the sheets and the clamping means mounted in cooperation therewith, for pressing the sheets over a particular area of the carrier. The compression takes place between the inlet point of the sheets to the carrier and a point further removed, whether along their transit route or at their point of outlet or exit from the carrier. The carrier and clamping means are mounted in a framework. Drive means are also provided for the carrier and/or clamping means. The inlet and transit or outlet points are each freely accessible, in contrast with the embodiments with windings as described in PCT/BE 90/00052. Furthermore, the pressure zone can have an adjustable position, form and/or dimensions. In addition, the pressure forces can be adjustable in magnitude, in time and according to location in at least a part of this area. Moreover, the pressure forces over one part of the given area can differ from the pressure forces over another part. In a first embodiment, the storage area between the carrier and the clamping means runs through more than one plane, with the entrance plane at the inlet point and the exit plane at the transit or outlet point forming an angle of less than 120 degrees. This angle will preferably be substantially 0 degrees: in this case thus, we are dealing with a so-called U-shaped storage area. The angle can also amount to substantially 90 degrees, which results in an L-shaped storage area.

The carrier can be a revolving belt, i.e. a conveyor belt which runs on a number of revolving rollers. In the case of a U-shaped storage area, two revolving rollers are normally provided. For an L-shaped or a V-shaped storage area, three revolving rollers are normally provided for the revolving belt. The revolving belt can be a full conveyor belt, a perforated belt or a set of mutually parallelly running belts. Stationary pressure clamps then face this revolving carrier, for example in the form of a series of spring-loaded bistable plates with suitable projections and recesses. The carrier can also be a stationary plate. In that case revolving clamping means are mounted opposite (facing) the carrier.

Preferably, however, a set-up will be chosen in which both the carrier and the clamping means revolve in cooperation and as explained in detail below.

Sometimes this will be a so-called continuous storage operation with simultaneous inlet and outlet of sheets. The sheets are then fed properly oriented into the inlet side of the revolving carrier in the collecting apparatus. After the at least local and temporary pressing and clamping by this carrier, they are conveyed in a mutually overlapping arrangement to an outlet side, where they are removed from the apparatus. This so-called continuous operation can take place in a closed circuit, as described in detail below. By preference, the revolving carrier and/or clamping means will advance step by step, with adjustable steps of a length equal to the distance d between corresponding transverse edges of two successive sheets. To this end the apparatus has been provided with suitable control devices, which are coupled, for example, to the drive means for the carrier and/or clamping belt and/or the processing unit to be operated.

In principle, the transportability of the collecting apparatus makes it possible to convey the series of sheets stored in it from one processing operation to another, as desired. In a total processing chain that includes several processing stations the sheets can therefore be repeatedly stored temporarily between subsequent stations as described above.

This means that the collecting apparatuses are alternately loaded at their inlet side with sheets in an overlapping arrangement and unloaded or emptied at their outlet side.

This repeating inlet/outlet cycle will even be capable of starting up from the moment the sheets are automatically taken up from a stack of cut sheets. Indeed the collecting apparatus can be connected to the outlet of a pick up station, as is known from U.S. Pat. No. 4,348,018 of the present applicant and similar to the take over process illustrated in FIG. 22 of PCT/BE 90/00052, in which the winding (13, 24, 80) is then replaced by a collecting apparatus according to this invention.

The newly formed sheet stacks that are produced by the cutting apparatus can then be conveyed properly from the cutting table up to or inside the pick up station, in which the sheets are then rolled one by one off the stack and conveyed to the first collecting apparatus according to the invention. This conveyor processing implies that the stack no longer necessarily needs to be lifted (by hand) from its support plate. It can remain on the same support plate or else be pushed on through. By this means the chances that the stack shape and sheet arrangement within the stack will be disturbed (associated with traditional processing involving repeated lifting and depositing on plates and transporting, e.g. in carts) is avoided.

By means of a series of collecting apparatuses that, arranged according to the invention, can be properly conveyed through the clothing manufacture workshop—e.g. on a rail circuit between the consecutive processing units—a considerable portion of the transport through the workshop can in fact be automated. In this way the "dead time" (i.e. now sometimes 70% to 80% of the overall working time between consecutive processing steps in a traditional workshop, as well as the employment of a relatively great number of operating personnel, can for the most part be avoided. Indeed, manipulation or handling time for the sheets by the operator are drastically reduced due to the use of a circuit of collecting devices according to the invention. Dead or idle time not only decreases the productivity or output of the machine group, but also increases the wear on the machines due to the repeated starting and stopping.

Due to the automation, the work is also transformed from monotonous production to a more ergonomic monitoring task involving less personnel. Finally, the installation of a circuit of collecting apparatuses between the consecutive processing stations makes it possible to reduce drastically the amount of space required for the group of processing machines (the processing chain). It also enables a greater standardization of the means of transport through the workshop.

The overall equipment for the processing of supple sheets therefore comprises at least one collecting apparatus and at least one sheet processing unit either directly or indirectly connected to it, along with means for exchanging said apparatus with a consecutive such apparatus.

In principle, the collecting apparatuses themselves for the application of the method include a sheet carrier mounted on a movable chassis, along with pressing or clamping means facing at least one particular area of the carrier. The framework is movable by means of, for example, guide brackets that engage into a guide rail. This rail is then installed throughout the workshop following an operating route appropriate for the processing units. The framework can also be moved by mounting it on a mobile chassis.

The apparatuses can be equipped with adjustment elements for adjusting the dimensions and possibly the relative position and/or shape of these clamping means. They can also be equipped with adjustment mechanisms for controlling the clamping pressure against the carrier.

When the method is a continuously operating temporary collecting operation, the apparatus includes a revolving conveyor belt as carrier, in which the clamping means face at least one flat side of the conveyor belt between the inlet and outlet sides for the sheets.

In principle, the clamping means can face the whole path covered by the conveyor belt, from the sheet inlet side to the sheet outlet side. In addition, they can be positioned stationary opposite the belt, or at least a part of them can be equipped with means for moving along with the belt. The apparatus can be equipped either with its own drive means, or else driven by means of a mechanical coupling with the nearby processing unit.

Some embodiments of the invention will now be explained with reference to the accompanying drawings. They are intended only as examples. Interesting aspects and additional advantages of the invention will also be explained.

FIG. 1 is a view of a collecting apparatus in which sheets to be processed are delivered out from it and in which processed sheets are again delivered into it in a converse sense in a closed circuit in the same apparatus.

FIG. 2 relates to a view of an similar apparatus, in which, among other things, an automation possibility for the inlet of the processed sheets is illustrated.

FIG. 3 represents in perspective a set-up in which the sheets to be processed are fed out from a first collecting apparatus and after processing are fed into a second processing unit.

FIG. 4 again shows a view of another set-up analogous to that in FIG. 1, but in which the sheets run through the processing unit in one direction.

Figure 1:
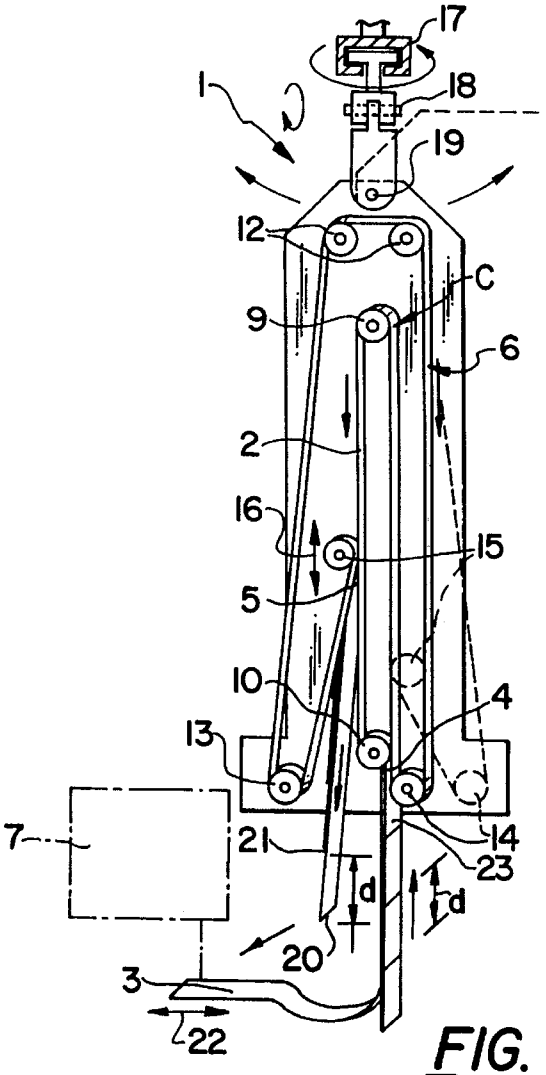
Figure 3:
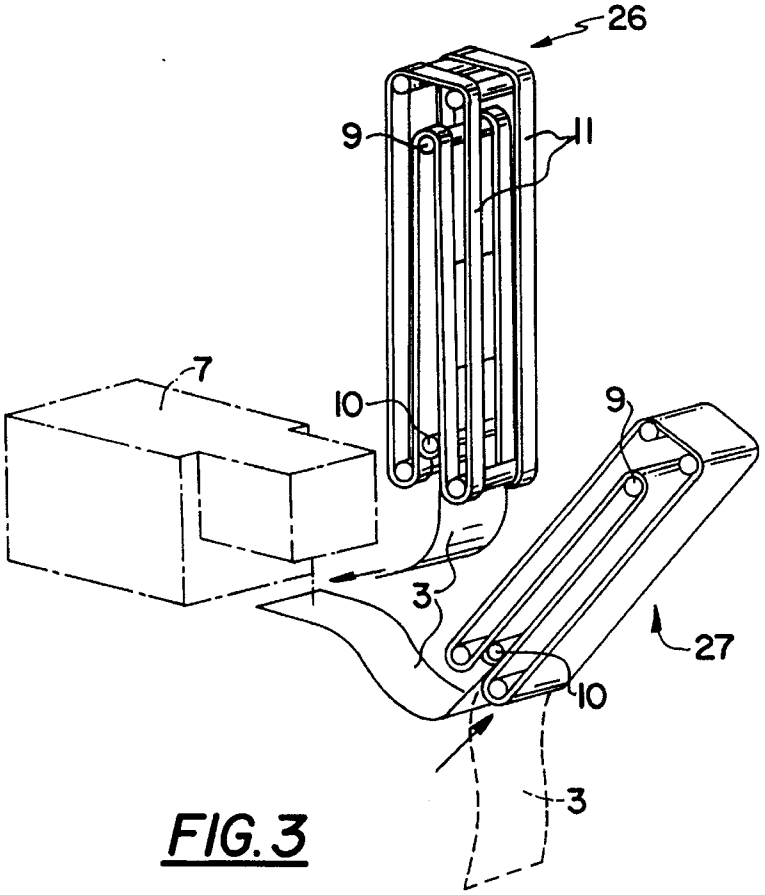

The movable collecting apparatus according to FIG. 1. for the temporarily and partially overlapping storage of a series of successive supple sheets 3 comprises a frame 1 for a revolving carrier C for the sheets. The revolving carrier C comprises in essence a belt transmission consisting of two revolving rollers 9 and 10 over which a conveyor belt 2 travels, or several conveyor belts 11 travelling alongside each other, as shown in FIG. 3. In conjunction or cooperation with the carrier C revolving clamping means 6 are provided for pressing the sheets over a particular area of the carrier C between their inlet point or point of entry 4 to the carrier C and a point further removed, whether on their transit route or outlet point (exit) 5. The inlet point 4 and the transit or outlet point 5 are each freely accessible.

The revolving clamping means 6 can, in a similar way to the carrier, consist of a conveyor belt or of belts 11 arranged alongside each other (FIG. 3), for example toothed belts. The exterior surfaces of the belt or belts of the carrier C and the clamping means 6 can both be smooth or both rough, or one can be rough and the other smooth, according to requirements. The belt or belts which constitute the clamping means 6 run over guide rollers 12, 13 and 14. Clamping rollers 15 can also be provided, whose position can be adjusted (arrow indicator 16) along the carrier route for modification of the sheet inlet point 4 and the sheet outlet point 5. In this manner the clamping area is thus provided with adjustable dimensions.

In order to ensure the movability of the collecting apparatus the frame 1 will preferably be suspended on guide means such as a rail 17 which travels through the clothing workshop along a suitable track for supplying the processing chains for the sheets via the collecting apparatuses. The frame 1 comprises the obvious assembly and support means for the rollers 9 to 15 and the drive means 8 (see FIG. 2) for the carrier. These drive means 8 can comprise a geared transmission which intermeshes at the level of the coupling with a processing unit 7 in a geared transmission which is driven by the motor which controls the processing operation (including the unit 7). The drive means can also contain a rotating cylinder, a straight cylinder with a ratchet and ratchet wheel or reversing ratchet.

The suspension of the rail 17 can in principle be arranged in such a way that the frame 1 is able to rotate around a vertical shaft running through the suspension point in the rail 17 and around two horizontal shafts arranged perpendicular to each other. The rotation around the horizontal shafts can be achieved using a suitable transverse suspension between the fork extremities 18 and 19 with a hinging facility. In this way it is possible in principle to achieve any inlet/outlet orientation for the sheets 3.

The operation of the collecting apparatus is as follows. The supple sheets 3 to be fed in can originate from an ordered stack of sheets, for example as delivered from the cutting room or as they are delivered one by one by a pick-up apparatus according to U.S. Pat. Nos. 4,348,018 or 4,437,655 of the applicant or from a processing unit 7, for example a hemmer, sewing machine, folder, etc. According to the sketch in FIG. 1 processed sheets 3, originating from the unit 7 are stored overlapping (in the U-shaped space) between the carrier C and the clamping means 6 cooperating with it. They are therefore presented in a suitable manner, either manually or using semi-automatic means, by the operator of the unit 7 at the inlet side 4 of the revolving carrier C. They are gripped between the conveyor belt and the clamping means 6 and locally pressed together, clamped and fed through into the (U-shaped) intermediate space to the outlet side 5. The transit of the sheets 3 through the apparatus should preferably take place in steps. Between every two consecutive steps there are rest periods or stops. Each step length d per sheet at the inlet, and also outlet, is thereby equal to the average distance between the foremost transverse edges 20 and 21 respectively of two consecutive sheets. Depending on the concrete processing situation (required processing length), it may be necessary to adjust the step length d. To this end suitable control means (not illustrated in detail), which are known per se, are provided in the drive means (8) of the collecting apparatus.

In fact, the entire concept of transport and handling of the supple sheets in accordance with the invention is related to their specific suppleness characteristics, as these occur in particular in the case of textile sheets. Supple sheets according to the invention are therefore to be understood as sheets which are particularly slack (or limp) and can in essence be folded in any given manner due to the nature of their texture, and which as a result can be straightened out at will from their folded state and refolded. This cannot be said of paper, for example, where the foldability is more limited and is often accompanied by creasing: which can then not be completely flattened out, in contrast to textile sheets. Furthermore, the sheets according to the invention will often have a hairy surface, as a result of which they slide over each other less easily than paper (which is usually smoother). This is advantageous in allowing the successive sheets if necessary to support each other somewhat during movement in their overlapping area and thus to prevent movements relative to each other, for example due to tendencies to displace (in contrast to smoother paper sheets). However, this also means that the mutual separation of overlapping supple sheets according to the invention will often mean that the overlapping sheets will (at least partially) have to be brought into a vertical freely hanging position in order to neutralise the effects of the hairiness (and consequently the small intrinsic mutual displaceability) and thus to be able to achieve separation without hitching or misalignment of the neighbouring overlapping sheet in their mutually overlapping contact area. This phenomenon is also something which does not occur in the handling of paper sheets or plastic films, for example, which always possess a relatively smooth surface and can therefore be slid horizontally over each other without disturbing each others' position. Finally, textile sheets are normally more stretchable than the majority of paper sheets and this can sometimes be of benefit to process, manipulate or handle them in accordance with the invention.

In summary, thus, the handling of textile sheets via inlet and outlet in an overlapping arrangement assumes on the one hand that the sheets end up in a correct orientation and position on each other. Indeed, if they are no longer lying correctly on each other it is no longer possible to slide them over each other without running the risk of disturbing the position of the neighbouring sheet. On the other hand (and in conjunction with the first condition), the relative mutual position of two overlapping sheets can only be altered if the pressure on each other in their mutual contact zone is sufficiently low so that a relative movement of one sheet does not again risk disturbing the position of the neighbouring sheet. The reduction of this contact pressure of the mutual contact surfaces can only be achieved in a simple manner by suspending their contact area practically vertically. From this position it is then possible to clamp the sheet edge in a suitable manner in order to feed in the sheet in the desired position to a following processing station using mechanical auxiliary devices such as clamps, grippers, guide plates, restackers, etc.

In the processing method sketched in FIG. 1, at the same time as the storage of processed sheets 3, originating from the unit 7 at the outlet point 5, the delivery is achieved of stored, non-processed sheets from the collecting area. These non-processed sheets are thus transported in a cycle to the unit 7 for processing. In concrete terms, the sheet is gripped with its leading edge 20 or mechanically clamped and when the trailing edge of this sheet is released from the outlet nip 5 the operator pushes the leading edge forward out of the mechanical clamp into the processing unit 7 (e.g. a sewing machine). After processing of this leading edge it is removed backwards from the unit 7. The sheet 3 is thus moved to and fro past the processing station for at least a part of the sheet length (see arrow 22). The trailing edge 23 of the processed sheet is now moved upwards into inlet 4 by the operator, possibly with the aid of semi-automatic or automatic aids (clamps or grippers). These aids can sometimes comprise a conventional restacker, which is available commercially. However, they will usually be designed specially for the purpose, as shown for example in FIGS. 8 and 9 attached.

Figure 2:
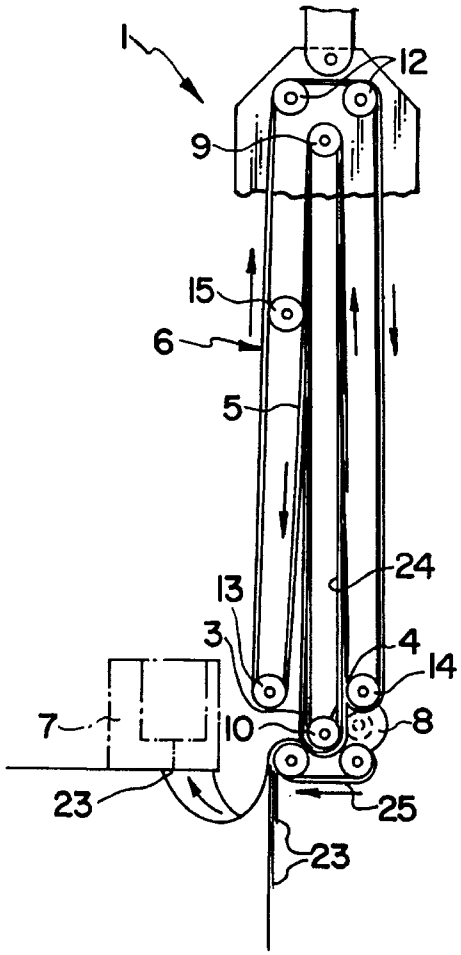

In the embodiment according to FIG. 2 the trailing edges 23 are allowed to run out at the outlet 5 past the clamping roller 15. At the same time, provision is made to ensure that the leading edge 24 has already been gripped at the bottom of the carrier by a suitable auxiliary and cooperating belt 25, which is then usually mounted in a fixed manner at the bottom of the collecting apparatus. The trailing edges 23 of the successive sheets are processed as explained in FIG. 1 and once again fed step by step into inlet 4 via the extremely advantageous embodiment with an auxiliary belt 25. The in-feed direction (orientation) of the sheet edge 23 in the unit 7 can form an angle (e.g. 90 degrees) with the outlet orientation at outlet 5. This can increase the ease of operation. In this embodiment no restacker is needed for feeding in the processed sheet at inlet 4. This embodiment is therefore cheaper. The length of the freely hanging portion (between two successive trailing edges 23) can be selected depending on the necessary processing length under the unit 7.

FIG. 3 shows a situation in which a sheet 3 is delivered out from a collecting apparatus 26 for processing and advanced after processing into a similar collecting apparatus 27. In apparatus 26 two sets of parallel toothed belts 11 are shown which face exactly each other around the U-shaped intermediate space between the belts 11 of the carrier C and those of the clamping means 6. The mutual distance of two belts running adjacent to each other can be adjusted as required. With the equipment according to FIG. 3 sheets 3 can also be delivered out simultaneously from both apparatuses 26 and 27 and be processed together, whereafter the processed sheet combination is fed back into apparatus 27. The carrier revolving over rollers 9 and 10 in the apparatus 27 can also be replaced by a stationary carrier, thus in the form of a fixed plate with two flat sections between fixed bars at the level of the rollers 9 and 10 indicated.

Figure 4:
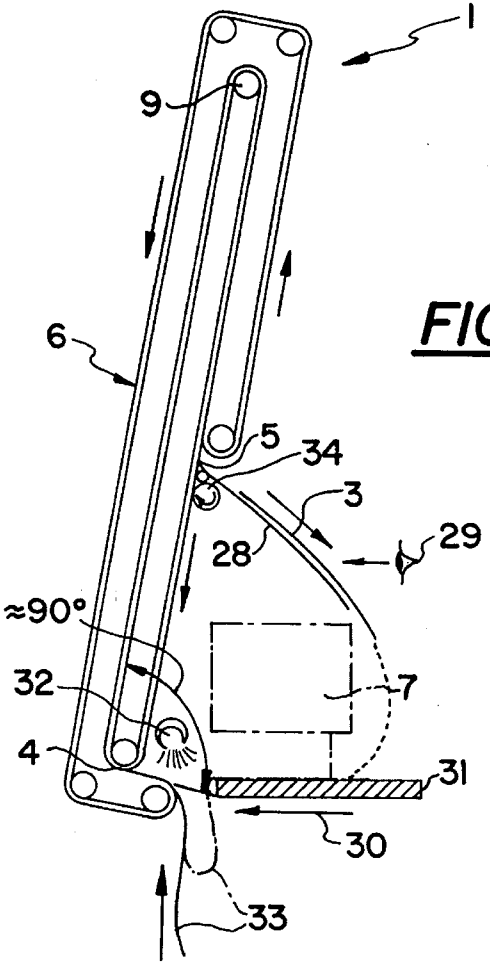

Instead of conveying the sheets 3 to and fro under the processing unit, situations can also occur in which they undergo a unidirectional conveying motion between discharge at outlet 5 and in-feed at inlet 4 past the unit 7. FIG. 4 relates to such an operation. It is specially suited for advancing sheets to the operator. After a sheet has run out at the outlet 5 it slides over a plate 28 until it is within reach of the operator 29 (shown schematically in looking direction in profile). The operation pushes the sheet into the processing apparatus (arrow 30) across the table 31 to the inlet 4 of the collecting apparatus on top of the previous sheets which are already clamped in the collecting apparatus 1. At the desired moment the operator allows the collecting apparatus to turn a desired step d (e.g. 4 cm), so that the leading edge of the sheet is clamped in inlet 4. The trailing edge 33 is then blown from the table 31 using a blower 32. The operator can now grip a new sheet at the outlet 5 and repeat the cycle successively sheet by sheet. In this embodiment inlet 4 and outlet 5 are not at the same height in the collecting apparatus 1. The apparatus 1 is preferably mounted with an inclination in order to facilitate release of the sheets at the outlet 5. A suitably driven roller 34 can assist here. In principle the embodiment according to FIG. 4 can be compared to an embodiment according to FIG. 2 by a rotating around a vertical shaft across an angle of 180 degrees.

Where the sheet travels through the unit 7 in one direction it is also possible in principle to employ a collecting apparatus in which inlet 4 and outlet 5 are located at the same level (above the processing unit). The sheet leaving at the bottom of the unit 7 is then gripped by its edge in a suitable clamping device and conveyed upwards for supply in at the inlet 4 of the apparatus 1.

Figure 5:
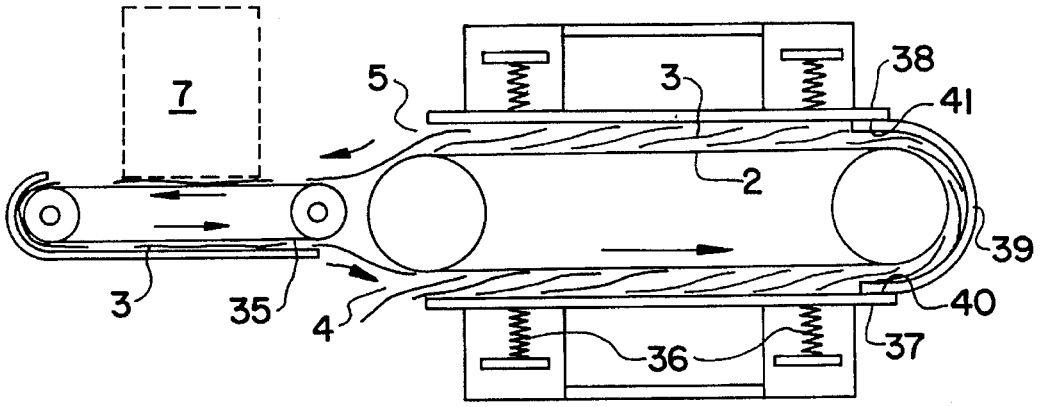
FIG. 5 shows a loading/unloading station for a processing unit in which the collecting apparatus contains a U-shaped storage space for the sheets between a revolving carrier surrounded by stationary clamping means.

A collecting apparatus as loading/unloading station for a processing unit 7 with accompanying means of conveyance 35 is sketched in FIG. 5 with a U-shaped storage space for overlapping sheets 3 between the conveyor belt 2 as carrier and the spring-loaded 36 facing pressure plates 37 and 38 as clamping means. Thus in the same apparatus, in principle, sheets to be processed in the nip 5 can be carried away (step by step) to the unit 7, while the processed sheets in inlet nip 4 are once again fed in overlapping arrangement.

If the apparatus is emptied of unprocessed sheets in area 5, it is at the same time once again filled up with processed sheets in area 4 and the apparatus, thus loaded again, can move on to the inlet side of the following processing unit.

The flexible curved bridging section 39 between the clamping plates 37 and 38 is characteristic of this apparatus This can be, for example, a film that, according to the given direction of rotation of belt 2, is fastened to the flat edge 40. (With the opposite direction of rotation, section 39 will be fixed to edge 41 and set free from edge 40). A U-shaped storage space that is loaded via an inlet 4 can be emptied, if need be, via the same nip 4 by reversing the direction of movement of the carrier. The last sheet taken in is then the first one taken out. (In this case, the outlet point 5 is thus actually not an outlet point, but should rather be regarded as being the ultimate point of transit.)

Figure 6:
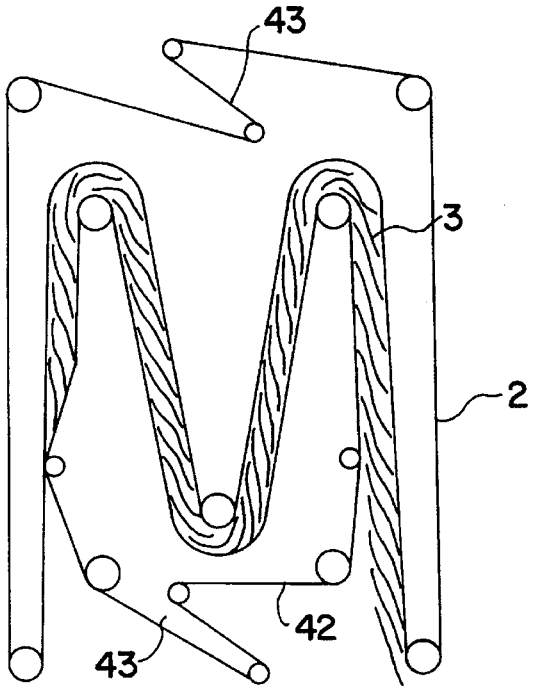
FIG. 6 shows an M-shaped storage space in which the clamping means move along with the revolving carrier.

Instead of a U-shaped storage space for the sheets, one can opt for an even more compact collecting apparatus in the form of an M or an S, for example. Other forms, such as an L, can of course also be taken into consideration. FIG. 6 shows an M-shaped storage space for the sheets 3 between two conveyor belts 2 and 42 that cooperate, the one operating as carrier and the other as clamping means moving along with it. The clamping pressure between the two belts can be regulated by means of tension mechanisms 43.

Figure 7:
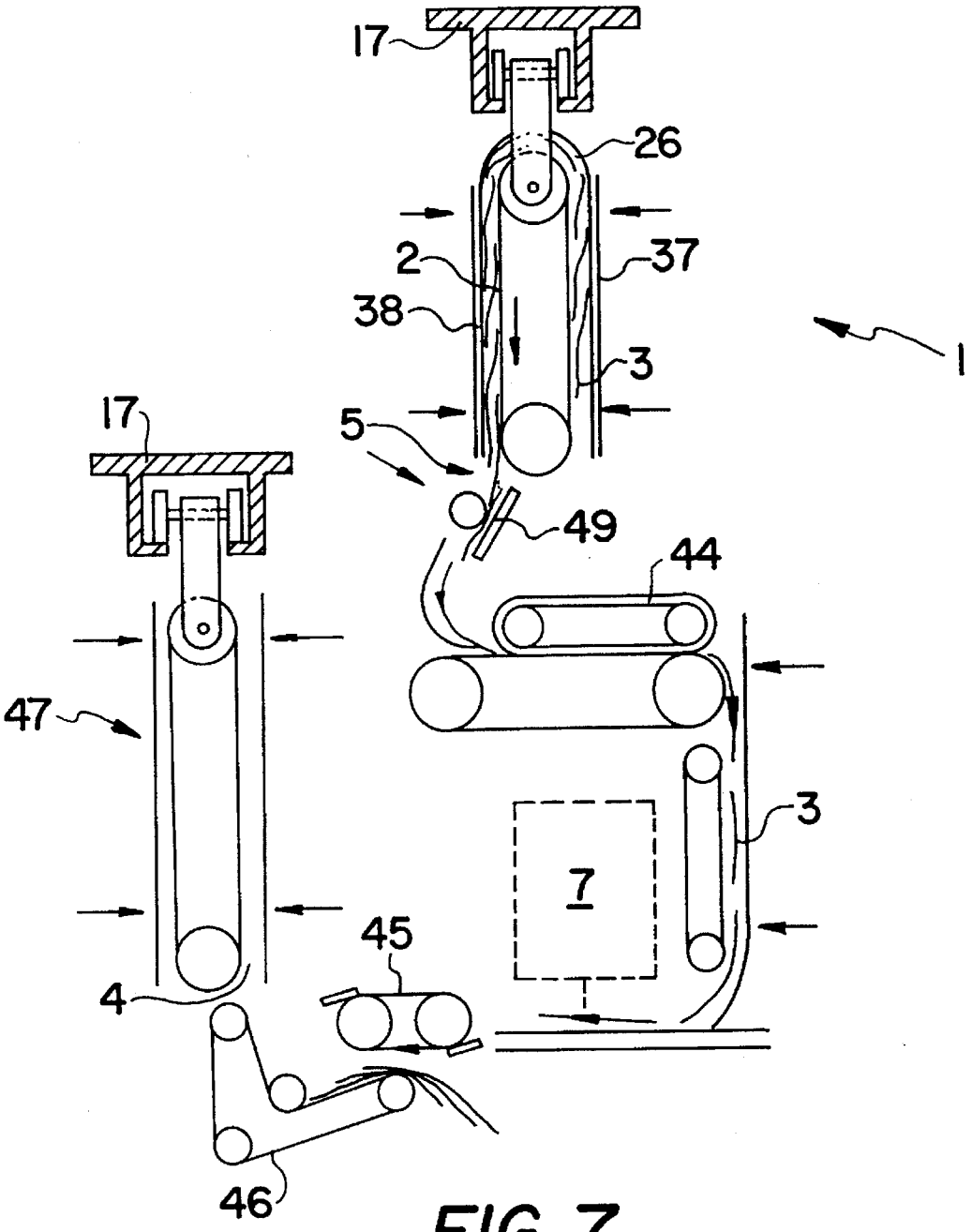
FIG. 7 illustrates the unloading from a first collecting apparatus and the storage after processing in a second collecting apparatus.

A handsome and convenient way to enable processing apparatuses 1 to circulate throughout a workshop with as little loss of space as possible consists in suspending the apparatuses 1 vertically on guide rails 17 by means of suitable rail hooks 48 and thus moving them along. The overall equipment of FIG. 7 illustrates this. Starting with collecting apparatus 1 positioned vertically (i.e. suspended movable on the rail 17) above the processing unit 7, sheets 3 are fed step by step at the outlet nip 5 into, for example, a positioning apparatus 44 for the sheets. From there they are further conveyed through the processing unit 7 to a restacker 45, that conveys them in an overlapping arrangement via bridging means, such as an intermediate conveyor belt 46 to the inlet 4 of collecting apparatus 47. At the level of the outlet area 5 and inlet area 5, respectively, shown in FIG. 7, appropriate intermediate stocks of a number of sheets can be stored in known bridging means 46, 49 in order to provide sufficient transition time to exchange the collecting apparatuses that service or cooperate with the processing unit 7. The purpose of the auxiliary devices is thus to feed in or carry away the sheets in an optimum manner to/from the collecting apparatuses and/or the processing units.

Figure 8:
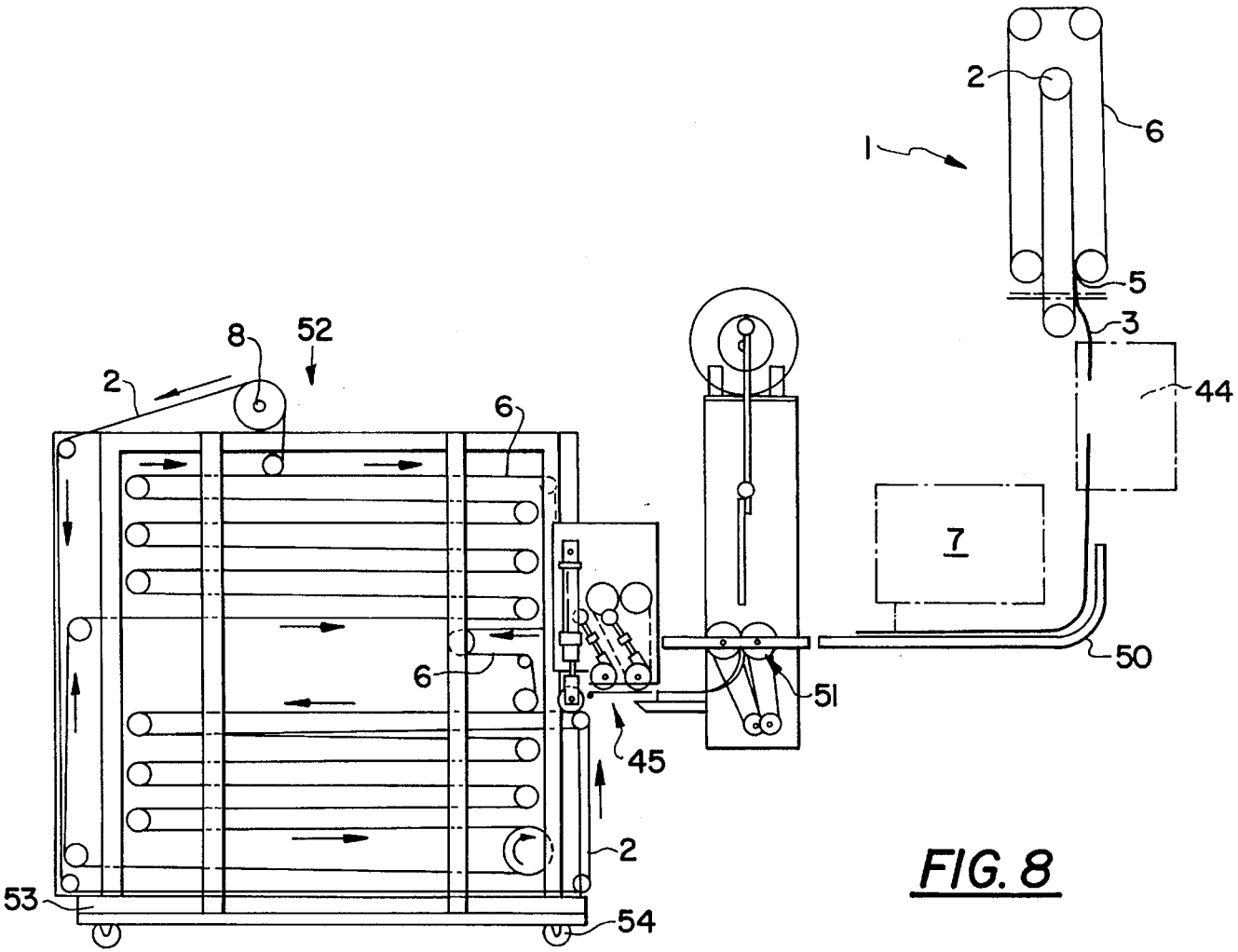
FIG. 8 is a sketch of a processing chain comprising two different types of collecting apparatus at the inlet and outlet of the chain.
Figure 10:
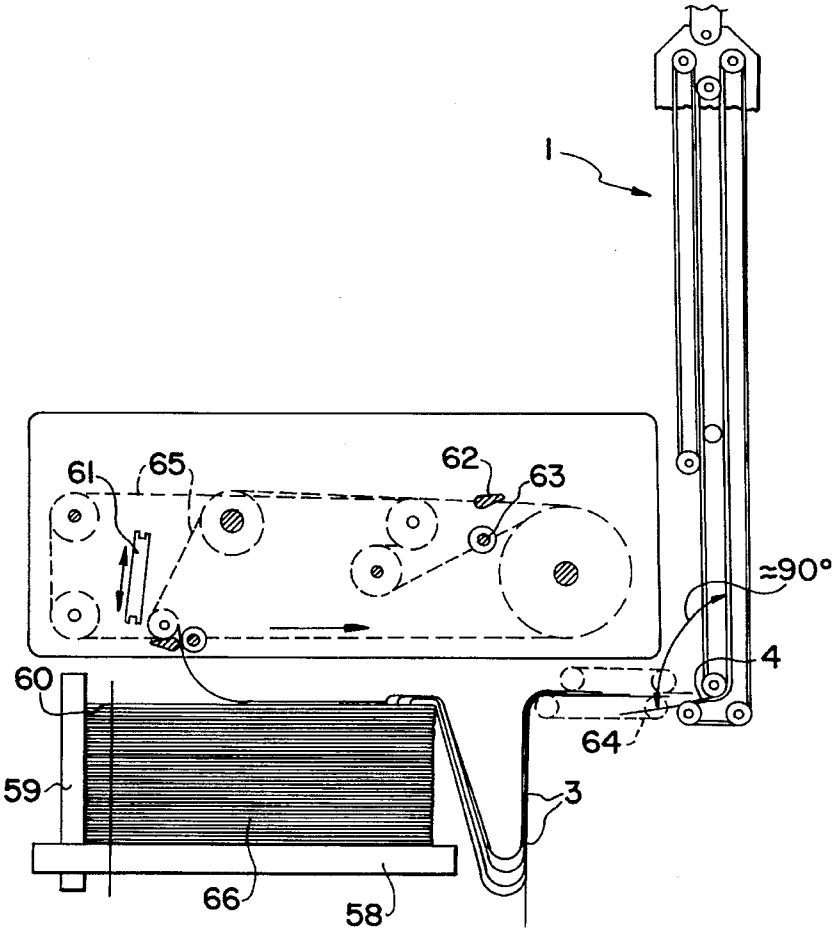
FIG. 10 shows a set-up in which sheets are automatically unrolled from a stack and fed, in an overlapping arrangement, to a collecting apparatus.

FIG. 8 shows a processing chain such as can occur in practice in a clothing workshop. The collecting apparatus 1 delivers the sheets 3 to a known positioning device 44 which conveys them downwards and over a guide plate 50 to a processing unit 7. At the same time as the vertical conveyance downwards, the positioning apparatus 44 translates the sheet transversally to the feed direction against a suitable stop so that the sheet edge arrives at the correct position at the unit 7. During processing of long sheets the leading edge can sometimes be processed in the correct position while the trailing edge is still in the positioning apparatus. The necessary space can thus be kept to a minimum.

The processed sheet can be advanced in a suitable overlapping arrangement to another collecting apparatus 52 at the exit of the processing unit 7 by means of a well known or specifically developed plying device 51 and a known restacker 45. The large collecting apparatus 52 is movably mounted (on swivelling wheels 54) on a chassis 53 wherein two cooperating belts 2 and 6 are arranged respectively as carrier and clamping belt in a zigzag path. The loading capacity for overlapping sheets is considerably higher than in the apparatuses 1 described above. The driving means 8 are of course monitored in coordination with the restacker 45. The sections of the conveyor path where carrier C and clamping belt 6 run in conjunction are indicated with a double arrow.

Figure 9:
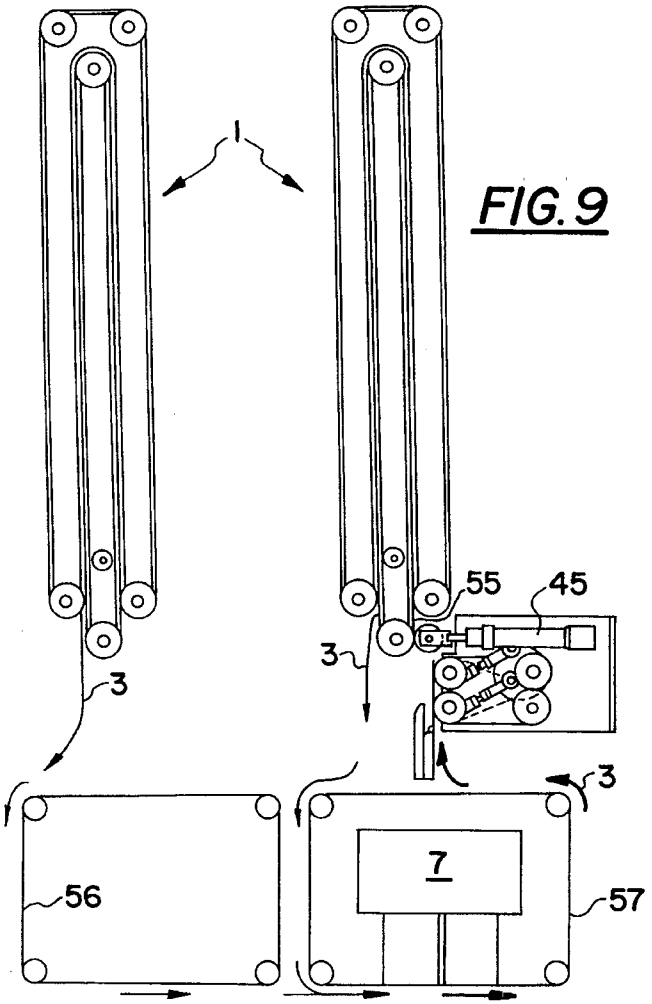
FIG. 9 illustrates schematically an apparatus for combining sheets.

FIG. 9 shows an arrangement in which two sheets 3, originating from two separate collecting apparatuses 1 are combined and, following a joint processing step in the processing station 7, are advanced together, via a restacker 45, into the inlet 55 of one of the apparatuses 1. The sheets are brought to, conveyed past and carried away from the unit 7 via suitable conveyors 56 and 57.

As indicated above, the sheets 3 can be rolled off an ordered sheet stack one by one with an apparatus as described in U.S. Pat. No. 4,437,655. The sheet stack 66 may be on a support plate 58, for example, coming from the cutting room. The stack lies against suitable stops 59 and is held on fixing needles 60. Up and down movable pick-up heads 61 pick up the sheets 3 one at a time and deliver them to gripper laths 62 attached to circulating chains 65, said gripper laths 62 operating in conjunction with revolving rollers 63 to transfer the separated sheet edges to a supply conveyor 64. From there they are suitably conveyed to the inlet 4 of the collecting apparatus 1.

Figure 11:
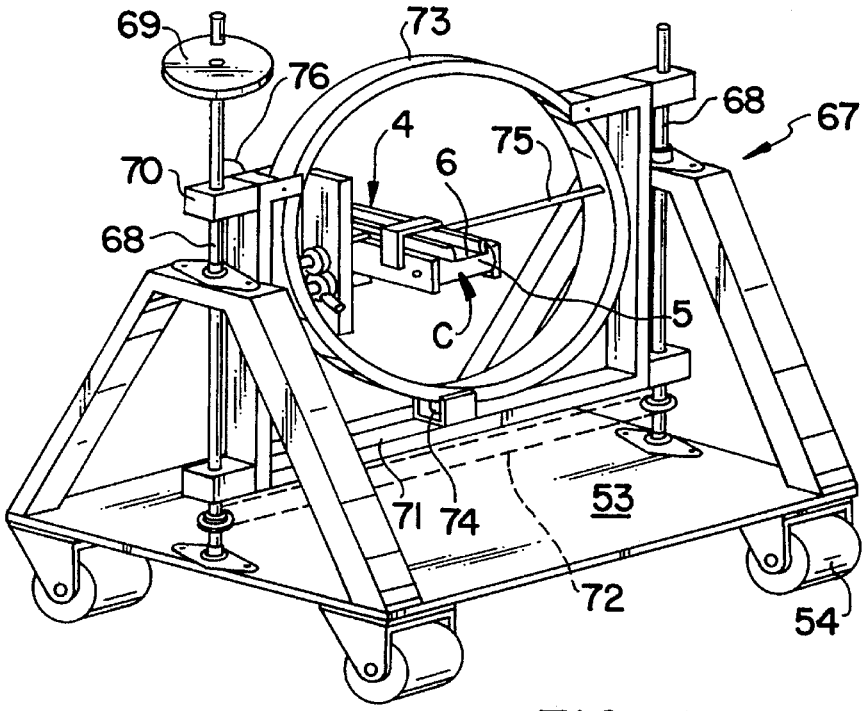
FIG. 11 shows a perspective view of a movable collecting apparatus in which the carrier and clamping means are mounted in such a way as to be rotatable around two horizontal shafts which are mounted perpendicular to each other.

Another movable embodiment of a collecting apparatus 1 with flexible operation is represented in FIG. 11. The carrier, for example in the form of a rotating carrier C and the clamping elements 6 that cooperate with it are rotatably suspended on various axles in a frame 67 that is mounted on a chassis 53 that rolls on swivelling wheels 54. On the chassis there are two vertical screwed rods 68 mounted, onto which the support blocks 70 for a frame 171 are arranged which can be moved up and down by means of cranks 69. The chain 72 transfers the rotation of the one screwed rod to the other. The frame 71 supports the vertical ring 73, which in turn supports the carrier C via a rotatable shaft 75. Due to the fact that the ring 73 can rotate, for example, via a crank 76 over toothed rollers 74 around a horizontal axle parallel to the direction of rotation of carrier C, it is possible to turn this carrier C upside down. By rotating (or revolving) the carrier C, which is attached to the axle 75, through 180 degrees, the carrier is also turned upside down, but at the same time its mutual ends are made to exchange places. The carrier C can al so be arranged in an inclined position in the apparatus. In conclusion, the apparatus therefore enables the carrier 2 to be translated (horizontally on wheels and vertically via crank 69) and to rotate around both a vertical axle (by means of swivelling wheels 54) and around two mutually perpendicular horizontal axles (by means of the rotation of ring 73 and by means of axle 75, respectively). The drive means for the belt are not shown on the drawing.

This embodiment therefore relates to a movable collecting apparatus for the temporary overlapping storage of a series of successive supple sheets, whereby the storage space between the carrier C and clamping means 6 extends in one plane between the inlet point 4 and the exit point 5, each of which is freely accessible.

An embodiment with storage space in one plane can also be suspended from a rail in a similar manner to the set-up in FIG. 1, for example. The suspension point 19 of the frame 1 can then be located halfway between rollers 9 and 10.

Figure 12:
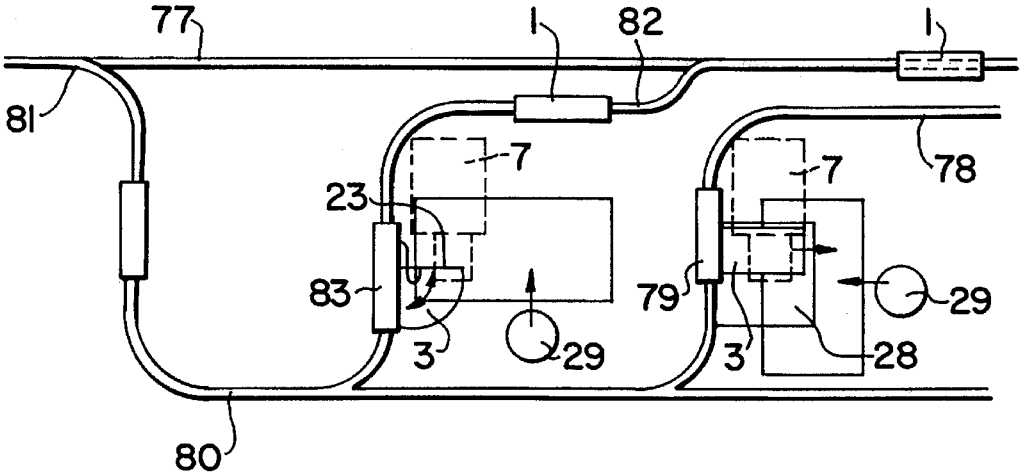
FIG. 12 shows schematically a circuit for collecting apparatuses passing along a number of processing units.

Finally, a principal set-up for a possible circulation path of the collecting apparatus in a workshop is explained with reference to FIG. 12. Let us consider the line 77 as being the main rail track in the workshop, with a branch rail 78 to the inlet position or processing station 79 of a first processing unit 7. This track runs on into a so-called bridge track 80 to the connector coupling or discharge position 81, from which it again forms the connection with the main track 77. The collecting apparatus rolls on the track to position 79 and there delivers its sheets to the operator 29 of the unit 7. The collecting apparatus in position 79 can be of a type such as that shown in FIG. 4, for example. The operator 29 takes the sheet 3 from plate 28 and pushes it through the unit 7 (e.g. a hemmer) for processing, after which it is returned back into the station 79. When all sheets 3 have been conveyed from the collecting apparatus in this station past the unit 7, the apparatus 1 from this station can continue to the bridge track 80, via the connector coupling 81, to the main track 77.

Another collecting apparatus 1, for example of the type according to FIG. 2, can be carried along the branch track 82 to the processing station 83. The operator 29 takes the sheet edge 23 out at the level of the processing station 83 and after processing it is returned to the station 83. After successive processing of all the sheets, the apparatus 1 in turn leaves station 83, across the bridge track 80, to the main track 77.

In fact, the whole workshop can be equipped with a series of processing chains in which several stations 79 and 83 are served simultaneously. In principle, each station then comprises an arrangement with guide means for the transport of collecting apparatuses which can be interchanged as required. The arrangement usually also contains auxiliary means such as guide plates 28, 50, positioning apparatuses 44, restackers and/or bridge conveyors 46, 49 or 64. Examples of these auxiliary means have been explained above and are inserted between collecting apparatus 1 and processing unit 7.

We claim:

1. A method for temporarily storing a series of successive textile sheets having a length L in an overlapping relationship in a collecting apparatus, comprising the successive steps of:

conveying the textile sheets one after another to an inlet of a carrier mechanism, while preventing an uncontrolled relative movement with a neighboring sheet in an overlapping contact area, clamping each textile sheet between the carrier mechanism and cooperating clamping means and conveying the clamped textile sheets along a path to an outlet of the carrier mechanism in successive steps having an adjustable step length d, removing the textile sheets from the collection apparatus at the outlet without disturbing a position of a neighboring sheet and displacing the carrier mechanism by one of translation, rotation and translation combined with rotation around one of a vertical axis and at least one horizontal axis.

2. The method according to claim 1, wherein the conveyance occurs in successive steps with stops occurring between said steps.

3. The method according to claim 2, wherein the apparatus further includes a processing unit, the method includes the additional step of carrying unprocessed sheets already stored in the apparatus in a cycle from the outlet of the carrier mechanism to an inlet of the processing unit at the same time processed sheets originate from the processing unit and are fed into the inlet of the carrier mechanism.

4. The method according to claim 3, wherein the step of carrying said textile sheets includes a back and forth movement of the textile sheets past the processing unit for at least a distance of a part of the length L of a sheet.

5. The method according to claim 3, wherein the step of carrying said sheets includes a unidirectional movement of said sheets past said processing unit.

6. The method according to claim 3, wherein following conveyance to the outlet of the carrier mechanism and to the processing unit, the method further includes step of carrying the textile sheets to another collecting apparatus.

7. The method according to claim 1, wherein the step of removing said sheets includes reversing a direction of movement of said carrier mechanism.

8. A movable collecting apparatus for temporarily storing and conveying a series of successive textile sheets comprising:

a frame;

a sheet carrying assembly having an inlet and a removal point, said assembly being mounted on said frame for carrying sheets to be collected, said assembly including:

a revolving carrier mechanism, at least one clamping member cooperating with said carrier mechanism so as to define a space for temporarily storing and pressing said sheets over a particular area between said inlet and said removal point, said inlet and said removal point being freely accessible, a driver for driving said assembly, and intermediate mechanical means for conveying the sheets between the assembly and another location in a desired position, said frame being constructed and arranged for movement by one of translation, rotation, and translation combined with rotation around one of a vertical axis and at least one horizontal axis, wherein said space extends in more than one plane, an entrance plane at said inlet and an exit plane at said removal point forming an angle less than 120°.

9. The apparatus according to claim 8, wherein said clamping member is adjustable so as to adjust the area of pressing.

10. The apparatus according to claim 8, wherein said clamping member includes at least a pair of rollers and a conveyor belt.

11. The apparatus according to claim 8, wherein said angle is substantially equal to 0 degrees.

12. The apparatus according to claim 8, wherein said angle is substantially equal to 90 degrees.

13. The apparatus according to claim 8, in combination with at least one processing unit operatively coupled therewith so as to be exchangeable with a collecting apparatus.

14. The combination according to claim 13, wherein said collecting apparatus operatively coupled with said at least one processing unit by one of a guide plate, positioning apparatus, a restacker and a bridge conveyor.

15. The apparatus according to claim 8, in combination with guide means for guiding movement of the apparatus over a predetermined path of movement.

16. A movable collecting apparatus for temporarily storing textile sheets comprising:

a frame;

a sheet carrying assembly having an inlet and a removal point, said assembly being mounted on said frame for carrying sheets to be collected, said assembly including:

a revolving carrier mechanism, at least one clamping member cooperating with said carrier mechanism so as to define a space for temporarily storing and pressing said sheets over a particular area between said inlet and said removal point, said inlet and said removal point being freely accessible, a driver for driving said assembly, and intermediate mechanical means for conveying the sheets between the assembly and a processing unit in a desired position, said frame being constructed and arranged for movement by one of translation, rotation, and translation combined with rotation around one of a vertical axis and at least one horizontal axis, wherein said driver includes a control device for a stepped advancement of one of the carrier mechanism and the clamping member with step lengths generally equal to a distance between corresponding transverse edges of two successive sheets.

* * * * *